US008453594B2

(12) United States Patent
Oldorff et al.

(10) Patent No.: US 8,453,594 B2
(45) Date of Patent: Jun. 4, 2013

(54) TILTED APPLICATION GROOVE HALVES FOR UNIFORMLY DISTRIBUTING A SUSPENSION TO A ROLLER MILL

(75) Inventors: Frank Oldorff, Schwerin (DE); Christoph Menier, Gaildorf (DE)

(73) Assignee: Flooring Technologies Ltd., Pieta (MT)

( * ) Notice: Subject to any disclaimer, the term of this patent is extended or adjusted under 35 U.S.C. 154(b) by 750 days.

(21) Appl. No.: 12/196,742

(22) Filed: Aug. 22, 2008

(65) Prior Publication Data

US 2009/0050054 A1 Feb. 26, 2009

(30) Foreign Application Priority Data

Aug. 23, 2007 (DE) ..... 10 2007 039 949

(51) Int. Cl.
*B05C 1/06* (2006.01)
*B05D 3/00* (2006.01)
*B05D 1/28* (2006.01)

(52) U.S. Cl.
USPC ..... 118/258; 118/223; 118/608; 118/244; 118/DIG. 15; 118/267; 427/195; 427/365; 427/428.08; 427/428.15; 427/428.01; 264/12; 428/141; 141/1; 141/32; 222/460

(58) Field of Classification Search
USPC ... 118/200, 223, 231, 608; 101/375; 428/156, 428/141; 141/1, 32, 33; 222/460, 462, 575; 220/565; 427/195, 365, 428.08; 264/12
See application file for complete search history.

(56) References Cited

U.S. PATENT DOCUMENTS

| | | | | | |
|---|---|---|---|---|---|
| 1,068,006 | A | * | 7/1913 | Pottinger | 193/3 |
| 1,377,976 | A | * | 5/1921 | Smith | 241/76 |
| 1,768,247 | A | * | 6/1930 | Gardner | 193/3 |
| 1,918,937 | A | * | 7/1933 | Shelton | 428/141 |
| 2,011,029 | A | * | 8/1935 | Barnwell | 15/250.16 |
| 2,279,361 | A | * | 4/1942 | Amstuz | 427/463 |
| 2,293,691 | A | * | 8/1942 | Harrigan | 118/249 |
| 2,333,902 | A | * | 11/1943 | Thiele et al. | 118/223 |
| 2,572,513 | A | * | 10/1951 | Paul | 118/223 |
| 2,984,874 | A | * | 5/1961 | Traue | 52/192 |
| 3,151,368 | A | * | 10/1964 | Dietert | 134/57 R |
| 3,289,898 | A | * | 12/1966 | Herman | 222/263 |
| 3,620,423 | A | * | 11/1971 | Dalgleish | 222/414 |

(Continued)

FOREIGN PATENT DOCUMENTS

| | | |
|---|---|---|
| DE | 616815 | 7/1935 |
| DE | 101 31 027 | 6/2001 |

(Continued)

OTHER PUBLICATIONS

European Search Report for Corresponding European Application No. EP 08 01 3512.

*Primary Examiner* — Dah-Wei Yuan
*Assistant Examiner* — Karl Kurple
(74) *Attorney, Agent, or Firm* — Andrew M. Calderon; Roberts Mlotkowski Safran & Cole, P.C.

(57) ABSTRACT

A device for applying a suspension to which particles, in particular corundum particles, have been added onto a base plate, with a roller mill comprising an applicator roll and a metering roll interacting with the applicator roll. An application groove with two groove halves project laterally and tilt downwards at an angle a to the horizontal with slots on the base side arranged above the roller mill.

27 Claims, 3 Drawing Sheets

U.S. PATENT DOCUMENTS

| | | | | |
|---|---|---|---|---|
| 3,885,519 | A * | 5/1975 | Orlowski | 118/16 |
| 4,223,632 | A * | 9/1980 | Cadwallader | 118/58 |
| 4,287,827 | A * | 9/1981 | Warner | 101/141 |
| 4,358,332 | A * | 11/1982 | Rodish | 156/356 |
| 4,377,230 | A * | 3/1983 | Burkner | 198/525 |
| 4,603,060 | A * | 7/1986 | Mitsuda et al. | 427/115 |
| 4,611,965 | A * | 9/1986 | Dixon et al. | 414/299 |
| 4,737,378 | A * | 4/1988 | Narita et al. | 427/8 |
| 4,738,879 | A * | 4/1988 | Williams | 427/288 |
| 4,741,929 | A * | 5/1988 | Kossuth | 427/258 |
| 4,949,667 | A * | 8/1990 | Yoshida et al. | 118/60 |
| 5,113,760 | A * | 5/1992 | Sonobe et al. | 101/348 |
| 5,160,377 | A * | 11/1992 | Montemayor et al. | 118/13 |
| 5,360,620 | A * | 11/1994 | Hsu | 426/432 |
| 5,382,291 | A * | 1/1995 | Olioso | 118/212 |
| 5,429,676 | A * | 7/1995 | Uchida et al. | 118/310 |
| 5,670,237 | A * | 9/1997 | Shultz et al. | 428/173 |
| 5,755,883 | A * | 5/1998 | Kinose et al. | 118/110 |
| 5,863,620 | A * | 1/1999 | Schafer | 427/508 |
| 6,055,781 | A * | 5/2000 | Johanson | 52/197 |
| 6,129,296 | A * | 10/2000 | Campbell et al. | 241/30 |
| 6,478,564 | B1 * | 11/2002 | Tieu et al. | 425/145 |
| 6,523,726 | B1 * | 2/2003 | Tschantz | 222/353 |
| 6,592,701 | B1 * | 7/2003 | Bonnebat et al. | 156/244.11 |
| 6,907,908 | B1 * | 6/2005 | Weldy | 141/67 |
| 7,204,883 | B2 * | 4/2007 | Rizzoli et al. | 118/262 |
| 7,632,434 | B2 * | 12/2009 | Duescher | 264/12 |
| 7,958,840 | B2 * | 6/2011 | Chappa | 118/304 |
| 2003/0116085 | A1 * | 6/2003 | Moden et al. | 118/419 |
| 2003/0143336 | A1 * | 7/2003 | Kobayashi et al. | 427/430.1 |
| 2006/0147637 | A1 * | 7/2006 | Cooprider et al. | 427/355 |
| 2006/0177591 | A1 * | 8/2006 | Raday | 427/430.1 |
| 2006/0226067 | A1 * | 10/2006 | Herron | 210/490 |
| 2008/0156212 | A1 * | 7/2008 | Yamada et al. | 101/375 |
| 2008/0196785 | A1 * | 8/2008 | Schmidhuber | 141/1 |
| 2008/0217985 | A1 * | 9/2008 | Botha | 298/11 |
| 2009/0136679 | A1 * | 5/2009 | Boukaftane et al. | 427/510 |
| 2009/0223591 | A1 * | 9/2009 | Farnish | 141/1 |
| 2009/0232998 | A1 * | 9/2009 | Krebs | 427/428.2 |
| 2010/0053239 | A1 * | 3/2010 | Furukawa | 347/6 |
| 2010/0242839 | A1 * | 9/2010 | Fett et al. | 118/244 |
| 2011/0244136 | A1 * | 10/2011 | Ryabova | 427/428.15 |
| 2011/0293823 | A1 * | 12/2011 | Bruderer et al. | 427/195 |
| 2012/0318193 | A1 * | 12/2012 | Specht | 118/202 |

FOREIGN PATENT DOCUMENTS

| | | |
|---|---|---|
| DE | 20 2004 018 710 | 4/2005 |
| JP | 57-081859 | 5/1982 |
| JP | 59-177159 | 10/1984 |
| JP | 2002-204995 | 7/2002 |

* cited by examiner

TILTED APPLICATION GROOVE HALVES FOR UNIFORMLY DISTRIBUTING A SUSPENSION TO A ROLLER MILL

CROSS-REFERENCE TO RELATED APPLICATIONS

The present application claims priority under 35 U.S.C. §119 of German Patent Application No. 10 2007 039 949.0, filed on Aug. 23, 2007, the disclosure of which is expressly incorporated by reference herein in its entirety.

BACKGROUND OF THE INVENTION

1. Field of the Invention

The invention relates to a device for applying a suspension to which particles, in particular corundum particles, have been added onto a base plate, wherein the device has an applicator roll and a metering roll interacting with the applicator roll.

2. Discussion of Background Information

A device is known, e.g., from DE 20 2004 018 710. The suspension to be applied is applied to the rotating metering roll and applied to the applicator roll by the metering roll. The quantity of the suspension to be applied is adjusted via a doctor blade located on the metering axis. The suspension is then applied to the surface of the base plate by the applicator roll.

The disadvantage of such a device is that a reservoir of the suspension to be applied must be placed upstream in the direction of rotation of the doctor blade located on the metering roll, in order to guarantee an application that is uniform over the entire width of the roll. A relatively large amount of the suspension, e.g., containing corundum, is therefore always available in the device, which leads to increased production costs. Moreover, the suspension has a relatively long dwell time in the reservoir. A sedimentation of the solid particles contained in the suspension thereby occurs at least in part. The suspension therefore no longer has a homogenous particle density, which leads to an irregular distribution of the particles on the base plate.

SUMMARY OF THE INVENTION

Based on the above problem, the invention provides an improved device such that a higher distribution accuracy of the suspension to be applied is guaranteed.

To attain this advantage, the device of the present invention comprises an application groove with two groove halves projecting laterally and tilted downwards at an angle a to the horizontal with slots on the base side. That is, the two groove halves extend in the direction of a roller axis starting from the middle of a roller mill. The suspension to be applied is introduced centrally from above into the application groove through a feed pipe. Since both of the groove halves are embodied sloping downward outwardly, the suspension is distributed by the force of gravity over the entire width of the application groove. The suspension can exit downwards through the slots in the base of the application groove and is thus applied uniformly onto the metering roll. It is therefore no longer necessary to form a reservoir on the roll itself.

The application groove is preferably provided with a central feed pipe.

Advantageously, the application groove extends over the entire width of the roller mill. A uniform application of the suspension onto the metering roll is thus guaranteed.

The application groove preferably has a trapezoidal cross section, where the short side of the trapezoid forming the base. The suspension introduced through the feed pipe is thus optimally fed to the slots provided in the base.

The side walls of the application groove are embodied in a closed manner, so that no suspension introduced can exit here. The side walls are the walls that delimit the application groove in the direction of the roller axis.

The slots provided on the base of the application groove preferably have a variable width. It has proven to be advantageous if the width of the slots increases from the center of the application groove towards its edges. The width of the slots is measured perpendicular to the roller axis. This ensures that the same quantity of suspension is applied onto the metering roll over the entire width of the application groove without it being necessary for this to form a reservoir in the application groove.

A previously established quantity of the suspension to be applied is introduced into the application groove in the center of the application groove. A small part of this suspension exits through the relatively narrow slots in the center of the application groove and reaches the metering roll directly. In embodiments, the largest part flows outwards along the tilted groove halves. The quantity of the suspension present in the application groove steadily decreases towards the outside. An increasingly large proportion of this increasingly reduced quantity is guided away downwards in order to guarantee a homogenous distribution on the metering roll lying below the application groove. This is achieved by the width of the slots increasing towards the edge of the application groove. As noted above, the width of the slots is measured perpendicular to the roller axis.

The width of the slots advantageously increases from the center of the application groove towards the edge from 1 mm to 20 mm, particularly advantageously from 1 mm to 10 mm. The width of the slots is preferably continuously variable. The optimal slot width can thus be adjusted for any desired application quantity.

The angle $\alpha$, at which the two groove halves are tilted outwards, is advantageously between 1° and 15°. An angle $\alpha$ of 5° has proven to be particularly advantageous. The flow characteristics of the suspension to be applied can be controlled through this tilt angle. This angle is preferably continuously variable. In this case the optimum gradient angle can be adjusted depending on the viscosity and the quantity of the suspension to be applied.

The surface of the metering roll and the applicator roll can be rubber-coated. Preferably the shore hardness of the rubber is 40 to 70, in particular preferably 55. EPDM (ethylene propylene diene monomer rubber) has proven to be suitable as the rubber.

Alternatively, the surface of the metering roll can also comprise ceramics or chromium-plated steel. The metering roll is preferably embodied as an anilox roller. The application quantity per area can be controlled by a grid comprising cells of certain size. The size of the cells and thus of the grid can vary.

If the surface of the applicator roll is provided with a fine grinding, the application quantity can be metered in a particularly precise manner, with a high distribution precision at the same time. A line-shaped or helical grinding pattern along the circumferential direction of the applicator roll has proven to be particularly suitable.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. The embodiment described below uses a belt and chain drive as transmission steps by way of example. However, the mechanisms described can also be applied to gear trains.

Figure 1:
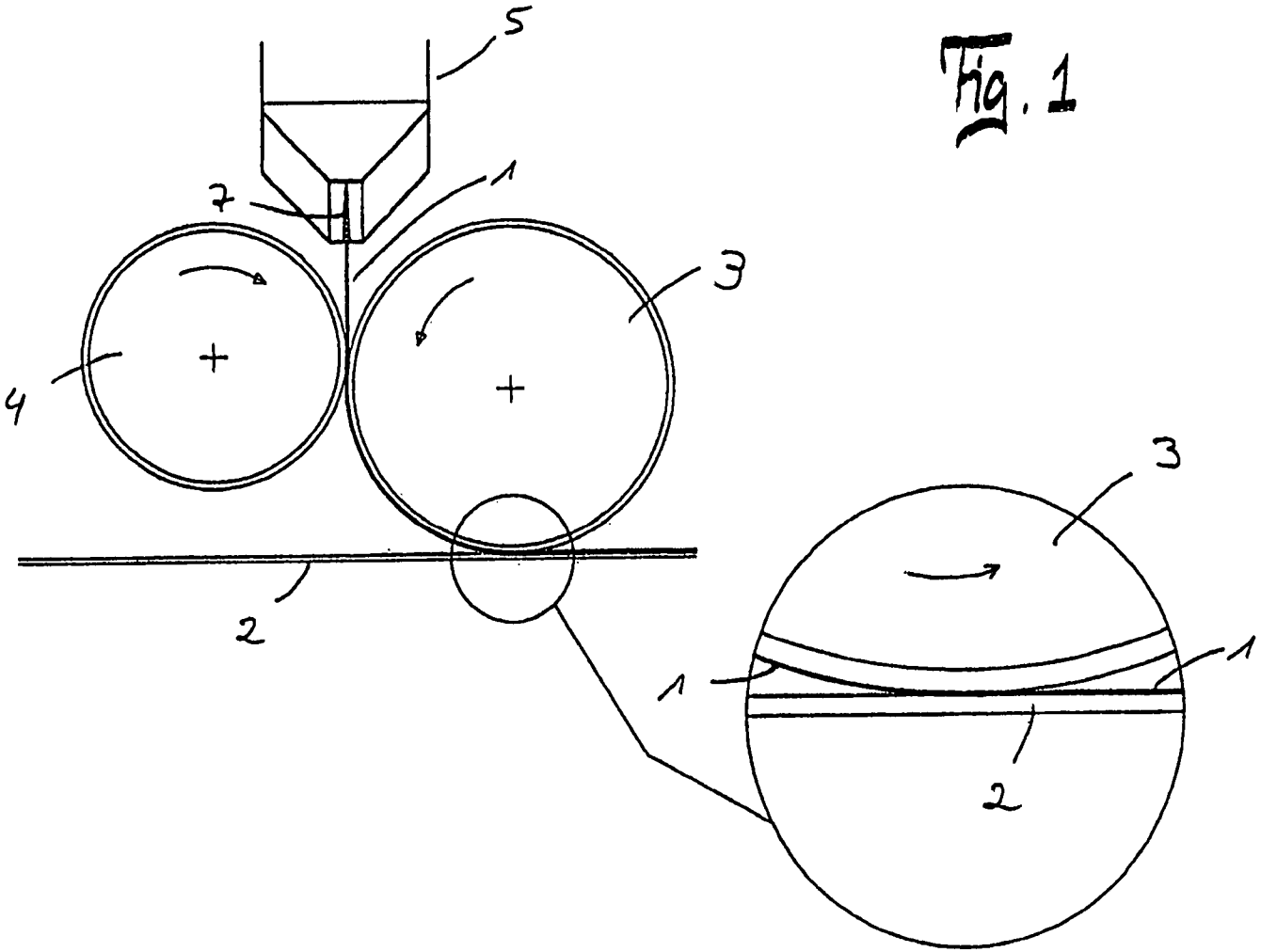
FIG. 1 shows a side view of a device according to the invention.

FIG. 1 shows a device according to the invention in side view. FIG. 1 shows a suspension 1 to be applied onto a base plate 2 as it exits from slots 7 located in the base of groove halves 6 of an application groove 5 arranged above the roller mill. The roller mill comprises a metering roll 4 and applicator roll 3, where the suspension 1 is guided directly into the nip between the metering roll 4 and the applicator roll 3. The quantity of the exiting suspension can be controlled via the adjustable width of the slots 7 and the adjustable angle a at which the groove halves 6 are tilted outwardly downwards. The application groove 5 can have a trapezoidal cross section, where the short side of the trapezoid forms the base.

In addition, by displacing the metering roll 4 or the applicator roll 3, the nip width between the two can be changed and the quantity of the applied suspension 1 on the base plate 2 can thus be controlled again. The surfaces of the applicator roll 3 and the metering roll 4 are coated such that the suspension 1 to be applied sticks to the applicator roll 3. The suspension 1 is transferred onto the base plate 2 by this applicator roll 3. This is shown more clearly in the enlarged section from FIG. 1. The respective direction of rotation is indicated by the arrows in the rolls 3, 4. It can be clearly seen in the enlarged section that the suspension 1 to be applied adheres to the applicator roll 3 in the direction of rotation before the contact between applicator roll 3 and base plate 2. After the contact, the suspension 1 has been transferred onto the base plate 2.

Figure 2:
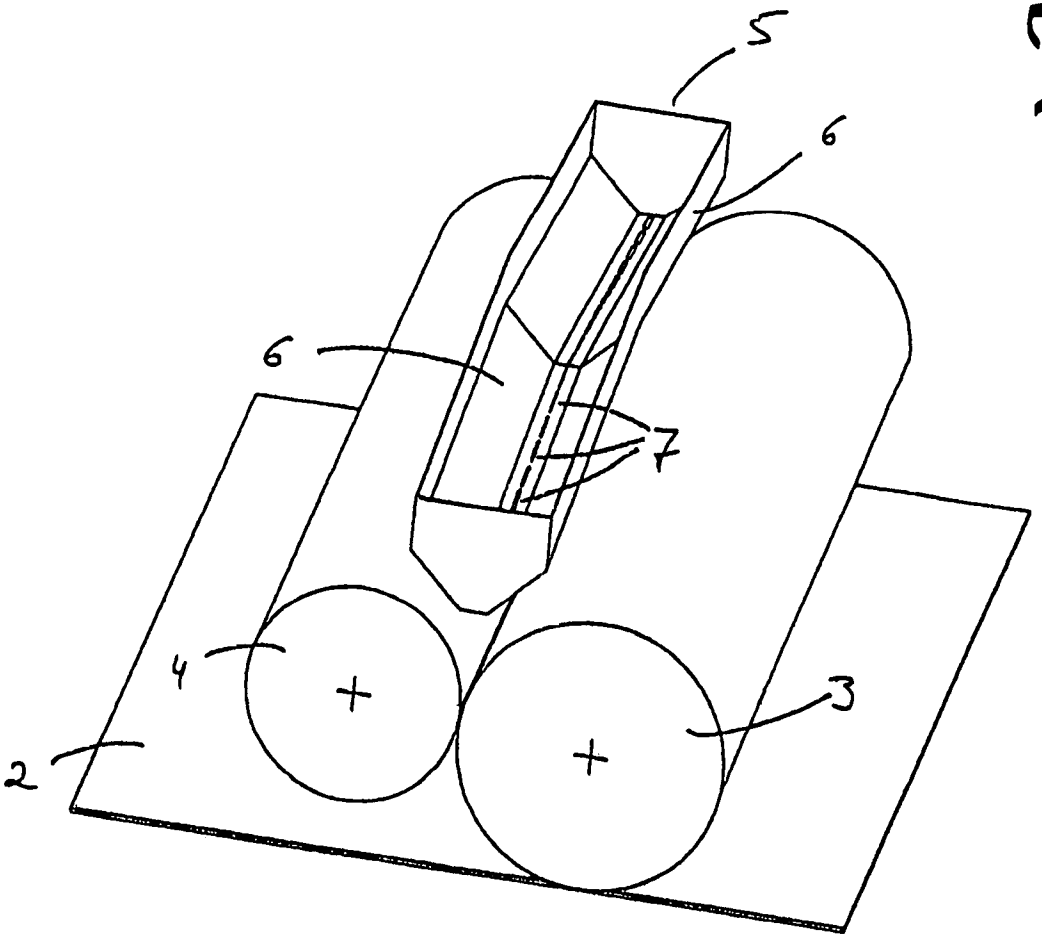
FIG. 2 shows a perspective representation of a device according to the invention.

FIG. 2 shows a perspective view of a device according to the invention. The application groove 5, which is located above the nip between metering roll 4 and applicator roll 3, has two groove halves 6 that are tilted downward starting from the center, where a central feed pipe 8 is also arranged. Located in the base of these groove halves 6 are slots 7 that have an increasing width from the center of the application groove 5 towards the sides.

The suspension to be applied, which is not shown in FIG. 2, exits through these slots 7. Through the trapezoidal cross section of the two groove halves 6, the suspension 1 guided through a central feed pipe into the application groove 5 is always guided to the slots 7. Both the tilt angle $\alpha$ of the groove halves 6 and the width of the slots 7 are continuously adjustable in order to thus be able to optimally control the quantity of the suspension exiting downwards depending on its viscosity and the required application quantity. The width of the slots 7 increases from the center of the application groove 5 towards the edge from 1 mm to 20 mm, and particularly advantageously from 1 mm to 10 mm. The width of the slots is preferably continuously variable. The optimal slot width can thus be adjusted for any desired application quantity.

As in FIG. 1, the suspension 1 exiting from the application groove 5 is guided directly into the nip between applicator roll 3 and metering roll 4. The suspension 1 is transferred onto the base plate 2 by the applicator roll 3.

The suspension 1 comprises a melamine resin corundum mixture and has a solid-resin proportion of 50% to 70%, preferably 60%, wherein additives, such as, for example, hardeners, wetting agents, release agents and flow-control agents as well as defoaming agents, are also added to the melamine resin, and in addition has a 30% to 60%, preferably 50% proportion of corundum, for example, aluminum oxide. The corundum has a size of approx. 0 to 120 μm. In addition to corundum, which serves to increase the abrasion resistance of the surface of the coated base plate, nanoparticles, for example silicon carbide can alternatively be added, which help to increase the scratch resistance of the surface. In addition, a reduction of dirt and bacteria will adhere to the surfaces equipped with nanoparticles.

A quantity of approximately 10 g/m$^2$ to 70 g/m$^2$, preferably 50 g/m$^2$ can be applied by coordinating with one another the rotational direction and rotational speed of the metering roll 4 and the applicator roll 3. The distribution accuracy is thereby approximately 90%.

Both the applicator roll 3 and the metering roll 4 are equipped with a rubber-coated surface. The shore hardness of the rubber of the surface is 40 to 70 and preferably 55. EPDM has proven to be suitable as the rubber. The surface of the applicator roll 3 is additionally provided with a fine grinding. A line-shaped or helical grinding pattern along the circumferential direction of the applicator roll 3 has proven to be particularly suitable. With an applicator roll embodied in this manner the application quantity can be particularly precisely metered with distribution accuracy at the same time.

Through the rubber coating of the surface of the rolls 3, 4 no abrasion or hardly any abrasion of the roll bodies occurs, since it has surprisingly proven that the elasticity of the rubber-coated surfaces withstands without damage the transport of the suspension to which the abrasive corundum has been added.

Alternatively, the surface of the metering roll 4 can also be made of ceramic or chromium-plated steel.

Figure 3:
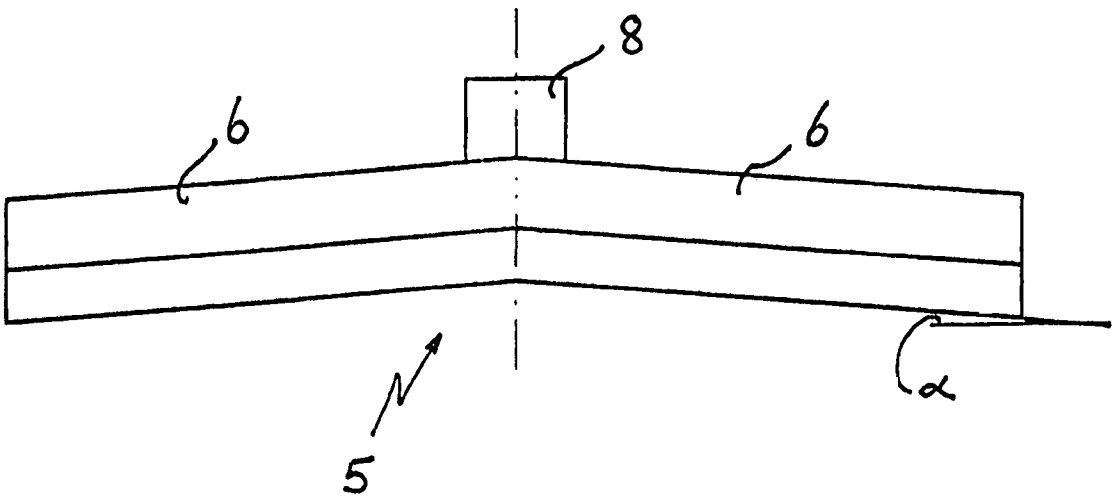
FIG. 3 shows the application groove in side view.

FIG. 3 shows the application groove in side view. This view clearly shows the groove halves 6 of an application groove 5. The groove halves 6 are tilted outwardly downwards by an adjustable angle $\alpha$. The angle $\alpha$ can be between 1° and 15° and preferably 5°. The central feed pipe 8 is also arranged between the two groove halves 6.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

It is claimed:

1. A device for applying a suspension including particles onto a base plate comprising:

a roller mill comprising an applicator roll structured and positioned to transfer suspension to a base plate, and a metering roll interacting with the applicator roll, wherein the suspension comprises a melamine resin corundum mixture with additives; and an application groove which delivers the suspension to the roller mill and which comprises two groove halves connected together at sidewalls and a base side, the two groove halves each projecting laterally and tilted downwards at an angle $\alpha$ to a horizontal with slots on the base side arranged above the roller mill, wherein the slots have a width increasing outwards from a center of the application groove towards opposing ends thereof.

2. The device according to claim 1, wherein the application groove extends over an entire width of the roller mill.

3. The device according to claim 1, wherein a cross section of the application groove is embodied in a trapezoidal manner.

4. The device according to claim 1, wherein side walls of the application groove are embodied in a closed manner.

5. The device according to claim 1, wherein a width of the slots increases outwards from 1 mm to 20 mm.

6. The device according to claim 1, wherein a width of the slots increases outwards from 1 mm to 10 mm.

7. The device according to claim 1, wherein the angle $\alpha$ is between 1° and 15° .

8. The device according to claim 1, wherein the angle $\alpha$ is 5° .

9. The device according to claim 1, wherein the application groove has a central feed pipe.

10. The device according to claim 1, wherein a surface of the metering roll and of the applicator roll is rubber-coated.

11. The device according to claim 10, wherein a shore hardness of the rubber is 40 to 70.

12. The device according to claim 11, wherein the shore hardness is 55.

13. The device according to claim 1, wherein a surface of the applicator roll has a grinding.

14. The device according to claim 13, wherein a line-shaped or helical grinding pattern is provided along a circumferential direction of the applicator roll.

15. The device according to claim 1, wherein a surface of the metering roll comprises ceramics.

16. The device according to claim 1, wherein a surface of the metering roll comprises chromium-plated steel.

17. The device according to claim 10, wherein the metering roll is embodied as an anilox roller.

18. The device according to claim 1, wherein the application groove is configured to dispense a quantity of approximately 10 $g/m^2$ to 70 $g/m^2$ of suspension by coordinating a rotational direction and rotational speed of the metering roll and the applicator roll.

19. The device according to claim 1, wherein the two groove halves extend in a direction of a roller axis starting from the middle of the roller mill.

20. The device according to claim 4, wherein the side walls delimit the application groove in the direction of a roller axis.

21. The device according to claim 1, wherein the width of the slots is measured perpendicular to a roller axis.

22. The device according to claim 1, wherein each of the two groove halves are tilted downwards starting from a first end at a center of the application groove to a second end at an edge of the application groove.

23. The device according to claim 22, wherein a distance of the first end is farther away from the applicator roll than a distance of the second end from the applicator roll.

24. The device according to claim 23, wherein the application groove is positioned above a nip of the applicator roll and the metering roll.

25. The device according to claim 23, wherein the suspension is applied to the applicator roll from the slots of the two groove halves.

26. The device according to claim 25, wherein the suspension sticks to the applicator roll.

27. The device according to claim 1, wherein the application groove is structured such that a smaller part of the suspension exits through narrow slots on the base side in a center of the application groove and reaches the metering roll directly, and a larger part, relative to the smaller part, flows outwards along the two groove halves which are tilted downward, wherein the suspension present in the application groove steadily decreases as it flows outwards and an increasingly large proportion of the suspension is guided away downwards to provide a homogenous distribution on the metering roll lying below the application groove.

* * * * *